US009745178B2

(12) United States Patent
Muraoka et al.

(10) Patent No.: US 9,745,178 B2
(45) Date of Patent: Aug. 29, 2017

(54) WORKING MACHINE AND MAINTENANCE METHOD THEREOF

(71) Applicant: KOBELCO CONSTRUCTION MACHINERY CO., LTD., Hiroshima-shi (JP)

(72) Inventors: Daisuke Muraoka, Hiroshima (JP); Takanori Yamasaki, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 481 days.

(21) Appl. No.: 14/264,340

(22) Filed: Apr. 29, 2014

(65) Prior Publication Data

US 2014/0346419 A1 Nov. 27, 2014

(30) Foreign Application Priority Data

May 27, 2013 (JP) ..... 2013-110749

(51) Int. Cl.
*E02F 9/00* (2006.01)
*B66C 23/62* (2006.01)
(Continued)

(52) U.S. Cl.
CPC ..... *B66C 23/62* (2013.01); *B66D 1/28* (2013.01); *E02F 3/962* (2013.01); *E02F 3/964* (2013.01);
(Continued)

(58) Field of Classification Search
CPC ..... B66C 13/52; B66C 13/54; B66C 23/62; B66C 2700/08; E02F 9/0833
See application file for complete search history.

(56) References Cited

U.S. PATENT DOCUMENTS 4,582,205 A * 4/1986 Berger ..... B66C 13/52 212/175
8,820,718 B2 * 9/2014 Weidner ..... B66D 1/00 254/329
(Continued)

FOREIGN PATENT DOCUMENTS

JP 58-45287 U 3/1983
JP 2001-187690 A 7/2001
(Continued)

OTHER PUBLICATIONS

Japanese Office Action issued Nov. 22, 2016 in Patent Application No. 2013-110749 (with unedited computer generated English translation).

*Primary Examiner* — Emmanuel M Marcelo
(74) *Attorney, Agent, or Firm* — Oblon, McClelland, Maier & Neustadt, L.L.P.

(57) ABSTRACT

Provided is a working machine including a device to be maintained and a winch disposed thereover and enabling a maintenance operation. The working machine includes a base machine, at least one device to be maintained installed at the base machine, and a winch which is driven to wind an operation rope. The winch is attached to the base machine to be pivotable, about a winch support shaft, between a use position at which the winch is used while closing at least a part of a maintenance space over the device to be maintained and a maintenance position at which the winch opens the maintenance space upward to enable the maintenance operation to be performed.

13 Claims, 3 Drawing Sheets

(51) Int. Cl.

| | |
|---|---|
| ***B66D 1/28*** | (2006.01) |
| ***E02F 3/96*** | (2006.01) |
| ***E02F 9/08*** | (2006.01) |
| ***E02F 9/20*** | (2006.01) |

(52) U.S. Cl.
CPC ..... *E02F 9/0833* (2013.01); *E02F 9/2016* (2013.01); *Y10T 29/49718* (2015.01)

(56) References Cited

U.S. PATENT DOCUMENTS

| | | | | |
|---|---|---|---|---|
| 2005/0199316 | A1 | 9/2005 | Ong | |
| 2011/0168417 | A1* | 7/2011 | Benesch | B66F 9/065 172/829 |
| 2015/0040519 | A1* | 2/2015 | May | A22C 11/125 53/416 |

FOREIGN PATENT DOCUMENTS

| | | | |
|---|---|---|---|
| JP | 2004-315226 | A | 11/2004 |
| JP | 2005-48380 | A | 2/2005 |
| JP | 2007-92455 | A | 4/2007 |
| JP | 2008-61653 | | 3/2008 |
| JP | 2011-105403 | A | 6/2011 |

* cited by examiner

WORKING MACHINE AND MAINTENANCE METHOD THEREOF

BACKGROUND OF THE INVENTION

1. Field of the Invention

The present invention relates to a working machine, for example, a forestry machine which is configured by utilization of a machine body of an excavator to perform drawing felled trees on the ground and gathering them, or the like, and a maintenance method for the working machine.

2. Description of the Related Art

There will be given an explanation of a background art of the present invention with reference of a swing yarder as an example of a forestry machine including a machine body of an excavator and a winch mounted thereto. The machine body of the excavator includes a lower traveling body of a crawler type and an upper slewing body slewably mounted thereon and having a cabin, and a front attachment mounted to a front portion of the upper slewing body, the lower traveler and the upper slewing body constituting a base machine. In the specification, a side of the working machine on which side the front attachment is mounted is defined as a front side of the machine, and respective directions of "front and rear" and "left and right" as to each of portions are defined based on the definition of the front side.

For example, Japanese Patent Application Laid-open No. 2008-61653 discloses a swing yarder, which includes a tower in addition to the machine body of the excavator and the winch. The front attachment includes an arm, and the tower is provided at a basal-end-side portion of the arm integrally with the arm in an upward directing attitude. The winch is mounted to the upper slewing body and driven to wind an operation rope. The operation rope is applied to a guide sheave provided at an upper portion of the tower and drawn out frontward to contribute to drawing felled trees on the ground, gathering them, or the like.

The swing yarder thus configured by utilization of the machine body of the excavator does not allow an exclusive space for installing the winch to be easily secured. The winch is therefore installed on an upper side of an existing equipment included in the upper slewing body. Specifically, the existing equipment includes a slewing motor as a slewing drive source of the upper slewing body and a control valve to control a hydraulic actuator related to the front attachment and the other hydraulic actuator; the slewing motor and the control valve are disposed on a rear side of a boom foot which is a base end portion of a boom. At a rear portion of the upper slewing body rearward therefrom, an engine room opened upward and an engine hood for opening and closing an opening portion of the engine room are provided, and the engine room accommodates an engine and related apparatus at a surrounding of the engine therein. The winch is installed over the slewing motor, the control valve, and the engine room. Particularly, if being a large-sized one, the winch is installed so as to completely close a space over the slewing motor and the control valve and also close a part of a space located over the engine hood and required for opening the engine hood.

This arrangement of the winch generates a difficulty in performing maintenance of devices to be maintained which device is disposed below the winch, namely, the slewing motor, the control valve, the engine peripheral apparatus and the like. In an ordinary excavator, respective maintenance operations of the devices are performed through respective spaces over the devices. Particularly, the maintenance for a device disposed around the engine is performed while the engine hood is opened. The winch disposed over the devices hinders the devices from their respective maintenance operations and also hinders the engine hood from being opened.

According to the arrangement, the maintenance of the devices requires the winch to be removed from the position over the devices, and this removal is not easy. In the conventional swing yarder, where the winch is fixed to the upper slewing body by a number of bolts, the maintenance requires respective operations of removing the number of bolts, lifting the entire winch by a lifting machine of a crane or the like and repositioning the winch and remounting the number of bolts following the completion of the maintenance. These operations require large-scaled equipment and involve troublesome procedures, significantly reducing an efficiency of the maintenance operation.

It is conceivable to install the winch at a high position far away upward from the devices to be maintained to thereby ensure a space for maintenance over the devices to be maintained; however, this arrangement, considerably enlarging a total height of the machine including the winch and deteriorating either of stability, mobility, and transportability of the machine, is hard to realize.

SUMMARY OF THE INVENTION

It is an object of the present invention to provide a working machine including a device to be maintained and a winch disposed thereover and enabling the maintenance operation of the device to be simplified and also provide a maintenance method thereof.

A working machine provided by the present invention includes: a base machine; at least one device to be maintained which is installed to the base machine so as to allow a maintenance space to be secured thereover for maintenance of the at least one device to be maintained; and a winch which is driven to wind an operation rope. The winch is attached to the base machine so as to be pivotable, about a winch support shaft, between a use position at which the winch is used while closing at least a part of the maintenance space and a maintenance position at which the winch opens the maintenance space upward to thereby enable the maintenance operation to be performed.

The present invention also provides a method of performing a maintenance operation of at least one device to be maintained of a working machine including a lower traveler, an upper slewing body slewably mounted thereon, a front attachment including a plurality of attachment elements and mounted to the upper slewing body, the attachment elements including a boom attached to the upper slewing body movably about a boom foot pin so as to be raised and lowered, an arm attached to a front end of the boom pivotably about a horizontal shaft, a boom cylinder for raising and lowering the boom, and an arm cylinder for pivoting the arm, the at least one device to be maintained installed to the upper slewing body so as to allow a maintenance space thereover for a maintenance operation of the at least one device to be maintained to be secured, and a winch which is driven to wind an operation rope. The method includes: attaching the winch to the upper slewing body so as to enable the winch to pivot about a winch support shaft between a use position at which the winch is used while closing at least a part of the maintenance space, and a maintenance position at which the winch opens the maintenance space upward to enable the maintenance operation to be performed; connecting the winch to a specific attachment element selected from the attachment elements through a drive-force transmission member; driving the specific attachment element or the winch and transmitting a drive force thereof to the winch through the drive-force transmission member to cause the winch pivot from the use position to the maintenance position; and performing the maintenance operation of the device to be maintained while the winch is located at the maintenance position.

DESCRIPTION OF THE PREFERRED EMBODIMENTS

Embodiments of the present invention will be explained in reference to the drawings. Each of the embodiments includes a swing yarder based on utilization of a machine body of an excavator, as an object to which the present invention is applied.

A first embodiment of the present invention will be explained in reference to FIG. 1 through FIG. 4.

Figure 1:
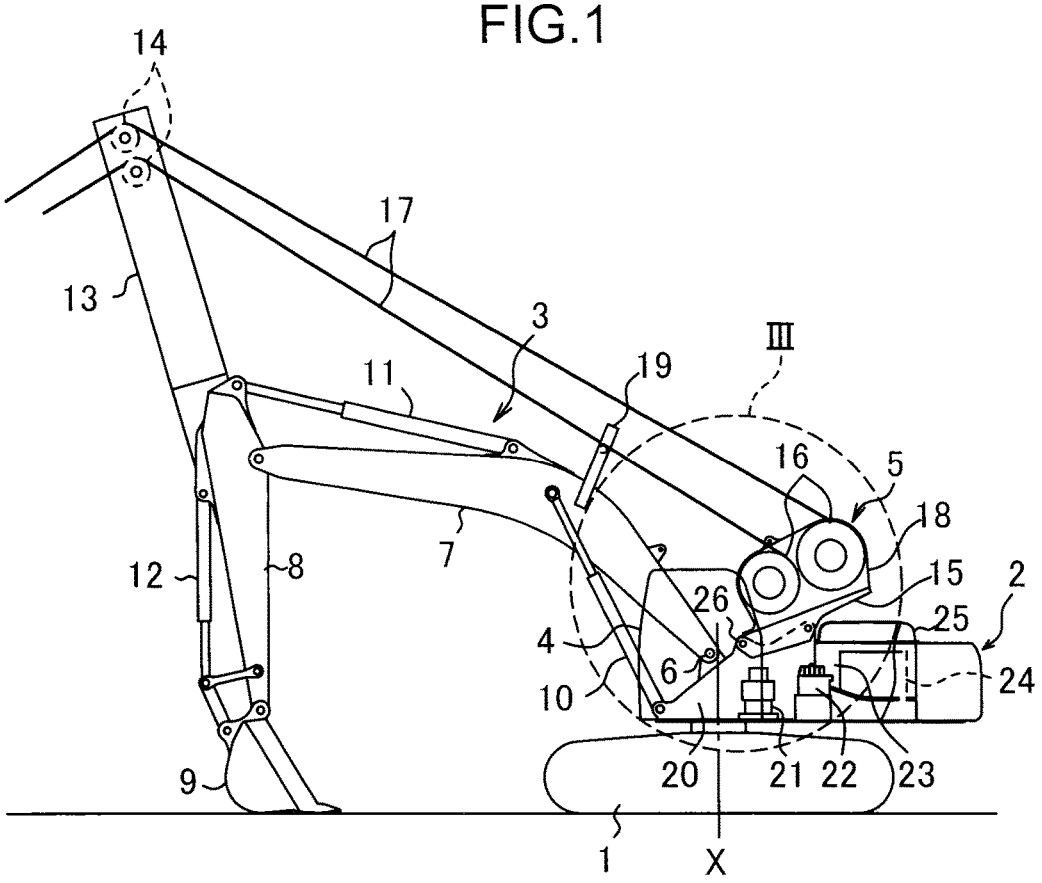
FIG. 1 is a partially broken side view of a swing yarder according to a first embodiment of the present invention.
Figure 2:
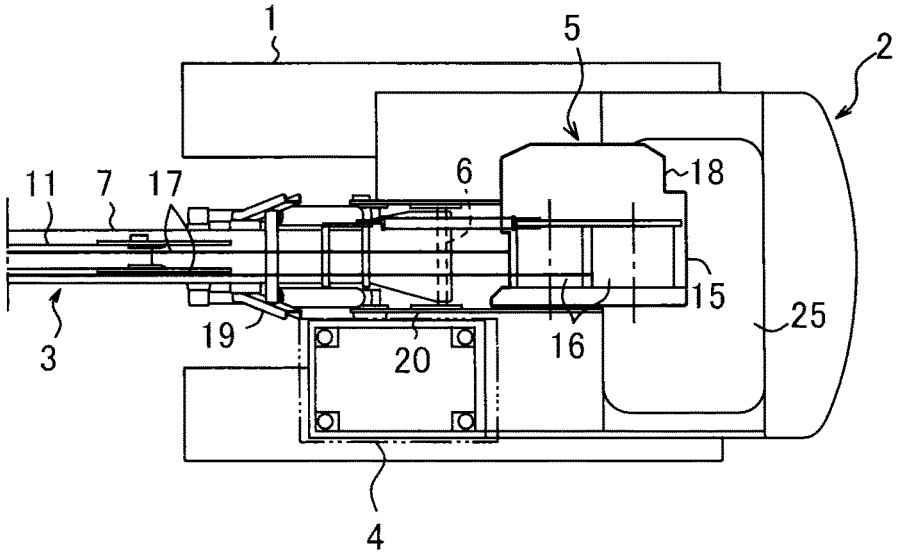
FIG. 2 is a plane view of the swing yarder.
Figure 5:
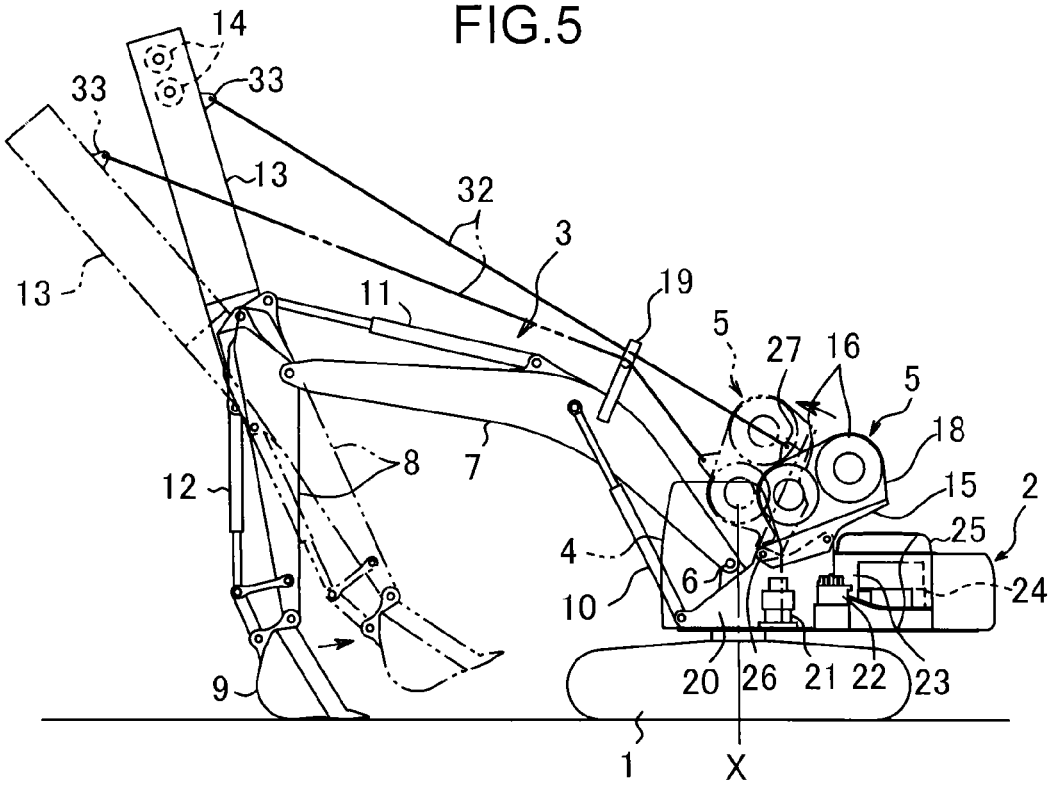
FIG. 5 is a partially broken total side view of a swing yarder according to a second embodiment of the present invention.

FIG. 1 and FIG. 2 show the whole structure of a swing yarder according to the first embodiment. The swing yarder includes: a mobile crawler-type lower traveler 1; an upper slewing body 2 mounted thereon slewably around an axis X perpendicular to the ground; a front attachment 3 installed substantially at a center position in a left and right direction of a front portion of the upper slewing body 2; a cabin 4 installed on the upper slewing body 2 at a position on a left side of the front attachment 3, a winch 5 mounted on an upper portion of a middle portion in a left and right direction of the upper slewing body 2; a plurality of devices to be maintained; and a tower 13. The lower traveler 1 and the upper slewing body 2 constitute a base machine of the swing yarder. FIG. 5 includes a bold line which indicates an outer shape of the winch 5.

The front attachment 3 includes a plurality of attachment elements, namely, a boom 7, an arm 8, a bucket 9, and a plurality of hydraulic cylinders. The boom 7 is attached to the upper slewing body 2 pivotably to be raised and lowered, about a boom foot pin 6 which is a horizontal shaft in the left and right direction. The arm 8 is attached to a front end of the boom 7 pivotably about a horizontal shaft in the left and right direction. The bucket 9 is attached to a front end of the arm 8 pivotably about a horizontal shaft in the left and right direction. The plurality of hydraulic cylinders include a boom cylinder 10 for making the boom 7 to pivot to be raised and lowered, an arm cylinder 11 for making the arm 8 pivot, and a bucket cylinder 12 for making the bucket 9 pivot.

The tower 13 is connected to a base end portion of the arm 8, that is, an end portion of the arm 8 connected to the boom 7, so as to pivot integrally with the arm 8. The tower 13 is provided with a pair of guide sheaves 14, 14 at an upper portion of the tower 13.

Figure 3:
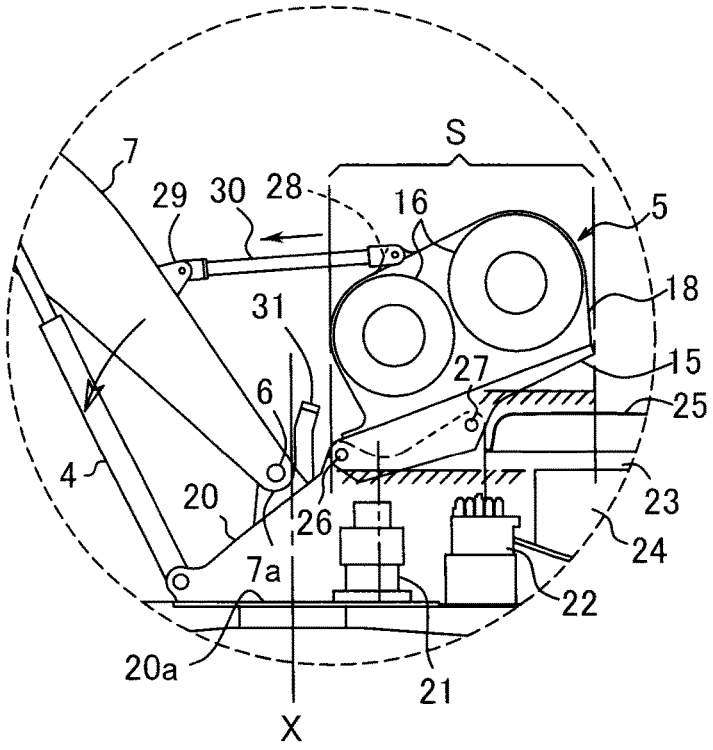
FIG. 3 is an enlarged view of a part of FIG. 1 surrounded by a circle III, and is a side view showing a state where a winch is disposed at a use position.
Figure 4:
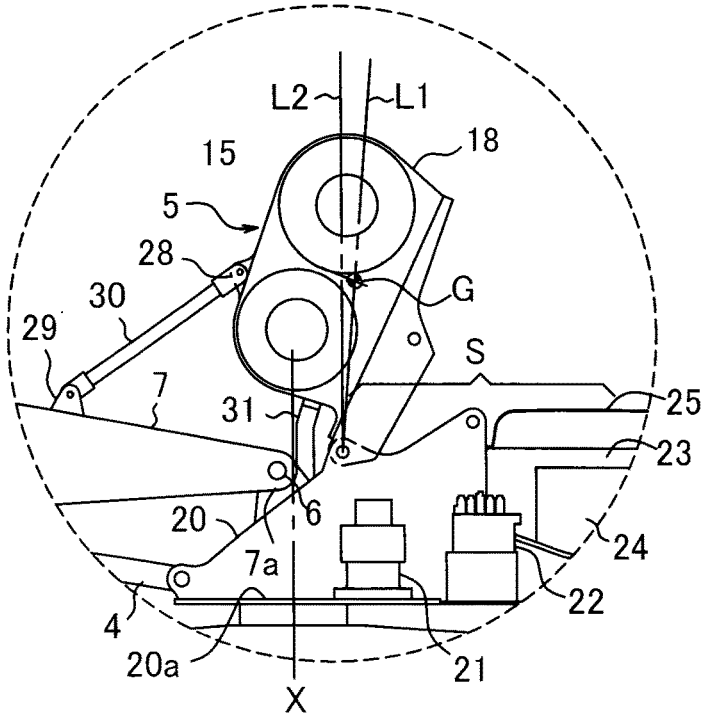
FIG. 4 is a view corresponding to FIG. 3 and is a side view showing a state where the winch is disposed at a maintenance position.

The winch 5 includes a winch frame 15, two winch drums 16 provided thereon, and a drive unit 18, as shown in FIG. 3 and FIG. 4. The winch drums 16 are aligned in a front and rear direction. Respective operation ropes 17 are wound around the winch arms 16 and 16. The operation ropes 17 are applied to the guide sheaves 14 and drawn out toward a front side of the working machine. The drive unit 18 includes a drive source, for example, a hydraulic motor, rotationally driving the winch drums 16 to make them wind and unwind the operation ropes 17. FIG. 1 through FIG. 4 show only a cover of the drive unit 18. Besides, as shown in FIG. 1 and FIG. 2, the boom 7 is provided with a guide member 19, at a rear face side portion of the boom 7, which prevents the operation ropes 17 and the boom 7 from their mutual interference.

The upper slewing body 2 includes an upper frame 20. The upper frame 20 includes a bottom plate 20*a*. The upper frame 20 is located substantially at a center in a left and right direction of the upper slewing body 2. On the other hand, the boom 7 includes a boom foot 7*a* which is a base end portion thereof, and the boom foot 7*a* is pivotably connected to the upper frame 20 via the boom foot pin 6.

The plurality of devices to be maintained include a slewing motor 21 and a control valve 22. The slewing motor 21 is a slewing drive source of the upper slewing body 2, for example, a hydraulic motor. The slewing motor 21 is installed at a position rearward of the boom foot 7*a* on the bottom plate 20*a* of the upper frame 20. The control valve 22, which is a valve for controlling respective operations of a plurality of hydraulic actuators including the cylinders 10 through 12 of the front attachment 3, is installed at a position further rearward of the slewing motor 21. The slewing motor 21 and the control valve 22 are installed to allow a maintenance space S to be secured thereover, as shown in FIG. 3 and FIG. 4, and maintenance operations of the slewing motor 21 and the control valve 22 are performed from an upper side through the maintenance space S.

The devices to be maintained also include an engine 24 and devices not graphically shown, related thereto (hereinafter, these are generally referred to as "engine related devices".). Specifically, an engine room 23 and an engine hood 25 are provided at respective positions rearward of the upper slewing body 2 and further rearward of the control valve 22, and the engine related devices are accommodated in the engine room 23. The engine related devices include, for example, a fan, other than the engine 24. The engine room 23 includes an opening portion opened upward, which serves as a maintenance aperture. The engine hood 25 opens and closes the opening portion. Specifically, the engine hood 25 is attached to a member forming the engine room 23 so as to allow an end portion of the engine hood 25 in a left and right direction or in a front and rear direction thereof to pivot about the one end portion as a fulcrum. Maintenance of the engine related devices is performed through the opening portion while the engine hood 25 opens the opening portion.

The winch 5 has a use position, at which the winch 5 closes the maintenance space S across over the slewing motor 21, the control valve 22, the engine room 23, and the engine hood 25. In details, at the use position, the winch 5 completely closes the maintenance space S over the slewing motor 21 and the control valve 22 and closes substantially front side half portions of the engine room 23 and the engine hood 25 to hinder the engine hood 25 from pivoting in an opening direction. In FIG. 3, the winch 5 closes a hatched portion. Hence, when the winch 5 is located at the use position, an operator cannot see the slewing motor 21 and the control valve 22 from an upper side, and also cannot reach the slewing motor 21 and the control valve 22 with his hand. Furthermore, the maintenance of the engine related devices is impossible because the engine hood 25 cannot be opened.

Hence, the winch 5 related to the swing yarder is attached to the upper slewing body 2 so as to have a maintenance position for the maintenance as shown in FIG. 4 in addition to the use position shown in FIG. 1 through FIG. 3, specifically, so as to be pivotable between the use position and the maintenance position. More specifically, a front end portion of the winch frame 15 is pivotably attached to the upper frame 20 by a winch support shaft 26 in parallel with the boom foot pin 6, and the winch 5 is thereby attached to the upper frame 20 so as to be pivotable in a front and rear direction about the winch support shaft 26.

The maintenance position is a position at which the winch 5 opens the maintenance space S upward as shown in FIG. 4. The winch 5, when located at the maintenance position, allows the operator to see the slewing motor 21 and the control valve 22 from the upper side thereof and reach the slewing motor 21 and the control valve 22 by his hand, further allowing the engine hood 25 to be opened up to an inherent opening angle. This allows the maintenance of the device to be maintained to be performed similarly to a case without the winch 5. In other words, the maintenance position (pivot angle) of the winch 5 is set to a position at which the winch 5 opens the maintenance space S upward enough to enable the maintenance operation of the slewing motor 21, the control valve 22, and the engine related devices to be performed.

A position of the winch support shaft 26 serving as a pivoting fulcrum of the winch 5 is set to a position immediately rearward of the boom foot 7*a* and above the boom foot 7*a* and the boom foot pin 6. The use position of the winch 5 is set to a position at which the winch 5 has a frontward and downward inclining attitude so as to vertically offset respective rotation centers of the front and rear winch drums 16 from each other as shown in FIG. 1 through FIG. 3.

The winch 5 can be fixed to the use position by use of a lock pin 27 as a lock member. The lock pin 27 is removably inserted across the upper frame 20 and a specific portion of the winch frame 15 of the winch 5 located at the use position, the specific portion being far away rearward from the winch support shaft 26 and corresponding to a middle portion of the winch 5 in a front and rear direction.

Next will be given an explanation of a method of making the winch 5 pivot between the use position and the maintenance position.

According to the first embodiment, it is possible to make the winch 5 pivot from the use position to the maintenance position by utilization of a downward pivoting force of the boom 7, and the winch 5 can be returned to the use position by utilization of an upward pivoting force of the boom 7, specifically, as follows.

Fixation portions 28 and 29 are provided on an upper surface of a cover of the drive unit 18 of the winch 5 and a back surface of a lower portion of the boom 7, respectively, and, for the maintenance operation, a rod 30 as a pivoting force transmission member is detachably provided between the fixation portions 28 and 29. The lock pin 27 is removed in this state and the boom cylinder 10 is contracted to make the boom 7 downward pivot, which allows the pivoting force of the boom 7 to be transmitted to the winch 5 through the rod 30 to perform as a force of making the winch 5 pivot frontward; the winch 5 thus pivot from the use position to the maintenance position. Meanwhile, the upper frame 20 is previously provided with a stopper 31 as shown in FIG. 3 and FIG. 4, which restricts the pivot of the winch 5 so as to prevent a linear line L1 interconnecting a center of the winch support shaft 26 and a gravitational center G of the winch 5 from coming over a vertical line L2 passing through a center of the winch support shaft 26 at the maintenance position. In the state of thus keeping the winch 5 at the maintenance position, the maintenance of the device to be maintained can be performed.

Following the completion of the maintenance operation, the boom 7 is driven to upward pivot in order to return the winch 5 to the use position. The pivoting force thereof is transmitted to the winch 5 through the rod 30 with a sufficient rigidity also in a compressing direction, making the winch 5 pivot rearward. The winch 5 is thus moved from the maintenance position to the use position.

According to the swing yarder and the maintenance method, the following effects can be achieved.

(I) The pivot of the winch 5 from the use position to the maintenance position about the winch support shaft 26 allows the maintenance space S over the devices to be maintained including the slewing motor 21, the control valve 22, and the engine related devices to be opened upward, thereby enabling the maintenance of the devices to be maintained to be performed. Both of the operation by the winch 5 and the maintenance operation are thus permitted to be performed only by the pivot of the winch 5. Hence, the maintenance operation including handling of the winch 5 can be efficiently performed in a short period of time with less effort, in comparison with the case of requiring the winch 5 fixed to the upper slewing body 2 by a number of bolts and the whole winch 5 to be removed from the upper slewing body 2 for the maintenance.

(II) The winch 5 can be firmly fixed at the use position by the lock pin 27. In addition, fixing the winch 5 to the use position and release therefrom can be swiftly performed by a simple operation of attaching and detaching the lock pin 27. This allows the maintenance operation to be further simplified.

(III) The swing yarder can be configured by utilization of the machine body of the existing excavator and the winch 5 can be easily and additionally attached thereto and activated. Furthermore, despite of the arrangement of the slewing motor 21, the control valve 22, and the engine hood 25 opening and closing the opening portion of the engine room 23 below the winch 5, the maintenance of the slewing motor 21, the control valve 22, and the engine related devices in the engine room 23 can be simplified.

(IV) The winch 5 is permitted to pivot in the front and rear direction about a front end portion thereof as a fulcrum by the attachment of the front end portion of the winch 5 to the upper slewing body 2 by the winch support shaft 26 in parallel with the boom foot pin 6; this allows the direction of the pivot of the winch 5 to coincide with a direction of drawing out the operation ropes 17. Hence, the operation ropes 17 cannot prevent the winch 5 from pivot even in a case of making the winch 5 pivot while the operation ropes 17 remains drawn out.

(V) Since the winch support shaft 26 is disposed rearward of the boom foot 7*a* and above the boom foot 7*a* and the boom foot pin 6, the pivot of the winch 5 to the maintenance position is less likely to involve an interference of the front end portion of the winch 5 with the boom 7, particularly, the boom foot 7*a*, in comparison with the case where the winch support shaft 26 is below the boom foot 7*a*. This allows the range of the pivoting angle of the winch 5 from the use position to the maintenance position to be increased to enlarge the area of upward opening of the maintenance space S opened by the winch 5 at the maintenance position, thereby further facilitating the maintenance operation.

(VI) The winch 5 has a front-downward inclined attitude at its use position to vertically offset respective positions of rotation centers of the both winch drums 16 from each other, which allows the interval between the winch drums 16, 16 required for ensuring a rope interval for avoiding an interference of the operation ropes 17 drawn out from the both winch drums 16 to be reduced. This allows the winch 5 to have a shortened dimension in the front and rear direction to be compact.

(VII) The maintenance method including connecting the winch 5 to the boom 7 via the rod 30 and transmitting the pivoting force of the boom 7 to the winch 5 through the rod 30 to make the boom 7 pivot between the use position and the maintenance position makes it possible to cause the winch 5 to pivot with no use of another machine such as a crane other than the working machine, thereby allowing the maintenance operation to be further simplified.

Incidentally, in a case of using the rod 30 as the pivoting-force transmission member as described above, the linear line L1 interconnecting the center of the winch support shaft 26 and the winch gravitational center G may have come over the vertical line L2 passing through the center of the winch support shaft 26 at the maintenance position of the winch 5. Even in this case, the upward pivoting force of the boom 7 can be transmitted to the winch 5 through the rod 30 with the rigidity enough to cause the winch 5 to pivot in a direction of returning the winch 5 to the use position. Besides, the rod 30 can also be used as a stopper for the pivot of the winch 5, thus allowing the stopper 31 to be omitted.

Next will be explained a second embodiment of the present invention with reference to FIG. 5. As to the second embodiment and the following third embodiment, only a difference from the first embodiment will be explained.

According to the second embodiment, a traction rope 32 is used as a pivoting-force transmission member in place of the rod 30 of the first embodiment. The pivoting operation of the winch 5 between the use position and the maintenance position is performed by utilization of the pivot of the arm 8 in a retracting direction and a pushing direction.

Specifically, a fixation portion 33 is provided at the tower 13 connected to the arm 8, and the traction rope 32 is provided between the fixation portion 33 and the fixation portion 28 of the winch 5. Accordingly, when the arm 8 is driven to pivot in a drawing direction by expansion of the arm cylinder 11, the winch 5 is caused to pivot from the use position to the maintenance position and held at the maintenance position by a stopper similar to the stopper 31 shown in FIG. 3 and FIG. 4. In this state, the maintenance of the devices to be maintained can be performed. Following the completion of the maintenance, driving the arm 8 to make it pivot in the pushing direction by contraction of the arm cylinder 11 allows the winch 5 to be returned to the use position by its own weight. The same effect as the basic effect of the first embodiment is thus achieved.

It is also possible to fix a tip of the traction rope 32 to a main body portion of the arm 8, for example, a front end portion of the arm 8, to allow the pivoting operation of the winch 5 to be performed by the pivot of the arm 8 in the pushing direction based on the contraction of the arm cylinder 11. Alternatively, the tip of the traction rope 32 may be fixed to the boom 7 similarly to the first embodiment to thereby allow the pivoting operation of the winch 5 to be performed by the downward and upward pivots of the boom 7.

Figure 6:
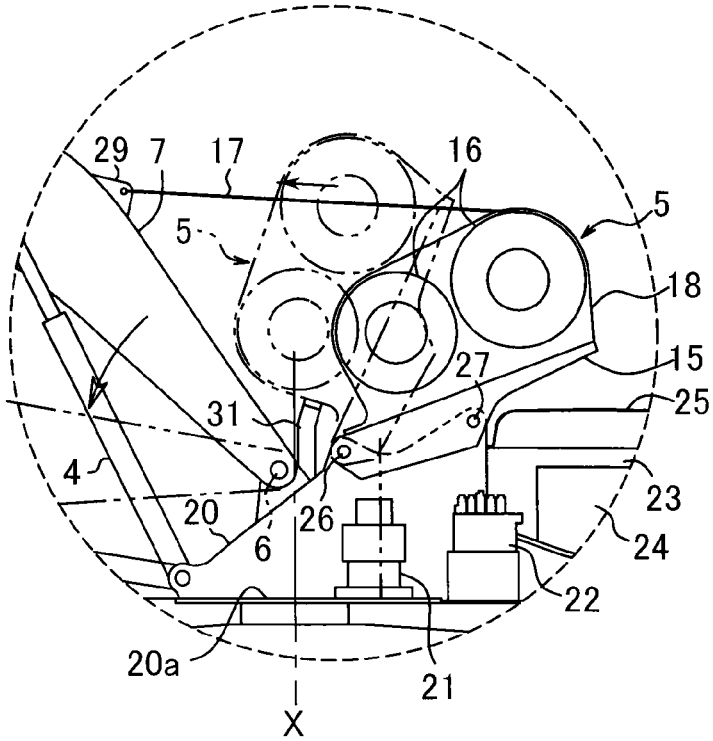
FIG. 6 is a view corresponding to FIG. 3 and is a side view showing an essential portion of a swing yarder according to a third embodiment of the present invention.

Next will be explained a third embodiment of the present invention with reference to FIG. 6.

According to the third embodiment, the pivot operation of the winch 5 pivot is performed by utilization of winding and rewinding the operation rope 17 by the winch 5. Specifically, the operation rope 17 drawn out from one of the winch drums 16, 16, for example, the winch drum 16 on a rear side, is utilized as the pivoting-force transmission member. In detail, a tip of the operation rope 17 is fixed to the fixing joint portion 29 of the boom 7. This makes it possible to cause the winch 5 to pivot between the use position and the maintenance position by rotating the winch drum 16 in the winding direction and in the rewinding direction while stopping the boom 7.

The third embodiment allows a further effect, in addition to the same effect as the basic effect of the first embodiment, to be achieved that the pivoting operation of the winch 5 can be performed more simply with no pivot of the boom 7 or the arm 8 of the attachment 3.

In the second embodiment and the third embodiment, preferably added is means for fixing the winch 5 to the maintenance position, for example, a pin to fix the winch 5 at the stopper 31 or at a position at a vicinity thereof, in order to ensure safety in case of an accidental brake in the traction rope 32 or the operation rope 17.

The present invention is not limited to the embodiments explained above, including, for example, the following embodiments.

(1) Means for fixing the winch 5 at the use position may be other than the lock pin 27. For example, the winch 5 may be fixed by at least one bolt.

(2) The winch according to the present invention is not limited to one provided with two winch drums 16 in parallel in a front and rear direction such as the winch 5 described above. The winch may, for example, include one or three or more of winch drums, or include a plurality of winch drums aligned in a left and right direction.

(3) The device to be maintained according to the present invention are not limited to the slewing motor 21, the control valve 22, and the engine related devices The number thereof is also not limited. The winch according to the present invention only has to close the maintenance space over at least one of the devices to be maintained at the use position.

(4) In the working machine according to the present invention, specific means for causing the winch to pivot is not limited. The winch may be caused to pivot by exclusive pivoting driving means, for example, such as a hydraulic cylinder or a gas spring.

(5) The present invention is not limited to the swing yarder configured by utilization of the machine body of the excavator as described above, but widely applicable to a swing yarder having a specification exclusive for forestry, or other working machines which includes a base machine and a winch installed to close a maintenance space over the device to be maintained.

As described above, according to the present invention, provided are a working machine which includes a device to be maintained and a winch arranged thereover and enables a maintenance operation of the device to be maintained to be simplified, and a maintenance method thereof.

A working machine provided by the present invention comprises: a base machine; at least one device to be maintained which is installed to the base machine so as to allow a maintenance space to be secured over the at least one device to be maintained for maintenance of the at least one device to be maintained; and a winch which is driven to wind an operation rope. The winch is attached to the base machine so as to be pivotable, about a winch support shaft, between a use position at which the winch is used while closing at least a part of the maintenance space and a maintenance position at which the winch opens the maintenance space upward to thereby enable the maintenance operation to be performed.

This working machine allows the maintenance space over at least one device to be maintained to be opened upward only by the pivot of the winch from the use position to the maintenance position about the winch support shaft to thereby produce a state possible to perform maintenance of the device to be maintained. In other words, the working machine can be switched between a state suitable for using the winch and a state suitable for maintenance of the device to be maintained under the winch only by the pivot of the winch. The maintenance operation including handling of the winch is thus allowed to be performed in a short period of time and with less effort in comparison with the case where, for example, the winch is fixed to the upper slewing body by a number of bolts and the entire winch must be removed for the maintenance operation.

Preferably, the working machine further includes a lock member adapted to be detachably fixed to the base machine so as to fix a portion of the winch, the portion being far away from the winch support shaft, to lock the base machine to the use position. The provision of the lock member enables the winch to be fixed firmly to the use position and allows the operation of fixing and releasing the winch to be simply and swiftly performed only with an operation of attaching and detaching the lock member to and from the base machine. This enables the maintenance operation to be further simplified.

The present invention can preferably be applied, for example, to the working machine further comprising a front attachment including a plurality of attachment elements and mounted to the base machine, wherein the base machine includes a lower traveler and an upper slewing body slewably mounted thereon, and the front attachment includes, as the plurality of attachment elements, a boom attached to the upper slewing body pivotably to be raised and lowered about a boom foot pin, an arm attached to a front end of the boom pivotably about a horizontal shaft, a boom cylinder for making the boom pivot to be raised and lowered, and an arm cylinder for making the arm pivot. In this case, the device to be maintained and the winch are preferably provided to the upper slewing body. The winch is thus allowed to be additionally and easily provided to the working machine configured by utilization of the machine body of the excavator, for example, the swing yarder, and to be activated.

The present invention can preferably be applied, for example, to a working machine further comprising an engine room installed to a rear portion of the upper slewing body on a rear side of a portion of the upper slewing body to which portion a boom foot as a base end portion of the boom is attached, the engine room having an opening portion opened upward, and an engine hood for opening and closing the opening portion of the engine room, wherein the at least one device to be maintained includes: a slewing motor provided between the engine room and the boom foot to slew the upper slewing body; a control valve provided between the engine room and the boom foot to control respective operations of a plurality of hydraulic actuators including the boom cylinder and the arm cylinder; and a plurality of engine related devices including an engine accommodated in the engine room and a device related to the engine. In this case, the maintenance position is preferably set to a position at which the winch opens a space over the slewing motor, the control valve, and the engine hood so as to allow the maintenance operations of the slewing motor and the control valve to be performed and allow the engine hood to be opened. This enables the maintenance of each of the slewing motor, the control valve, and the engine related devices, which are the devices to be maintained, to be simplified.

In this case, it is preferable that: the winch support shaft is a horizontal shaft in parallel with the boom foot pin; and a front end portion of the winch is attached to the upper slewing body through the winch support shaft so as to make the winch pivotable in a front and rear direction about the front end portion of the winch as a fulcrum. This allows a pivoting direction of the winch to coincide with a direction of drawing the operation rope from the winch, thus preventing the operation rope from hindering the winch from pivoting, even in a case of making the winch to pivot while the operation rope remains drawn out. Besides, it is possible to cause the winch to pivot by utilization of a winding/rewinding operation of the winch.

In this case, the winch support shaft is preferably located above the boom foot which is a base end portion of the boom and on a rear side of the boom foot. This makes an interference of the front end portion of the winch pivoting to the maintenance position with the boom, particularly, the boom foot, be less likely to occur than in a case of locating the winch support shaft below the boom foot. This allows the range of the pivoting angle of the winch from the use position to the maintenance position to be increased to enlarge an area of the upward opening of the maintenance space which the winch at the maintenance position opens. The maintenance operation is thereby further facilitated.

Besides, it is preferable that: the winch includes a plurality of winch drums aligned in a front and rear direction to be driven to wind an operation rope; and the use position is set to a position at which the winch has a front downward inclined attitude to vertically offset respective positions of rotation centers of the winch drums from each other. Thus setting the use position enables intervals between the winch drums required for securing the intervals of the operation ropes for avoiding an interference of the operation ropes drawn out with each of the winch drums to be decreased. This allows the winch to have a shortened length dimension in the front and rear direction to be compact.

The method provided by the present invention is a method of performing a maintenance operation of at least one device to be maintained of a working machine including a lower traveler, an upper slewing body slewably mounted thereon, a front attachment including a plurality of attachment elements and mounted to the upper slewing body, the attachment elements including a boom attached to the upper slewing body movably about a boom foot pin so as to be raised and lowered, an arm attached to a front end of the boom pivotably about a horizontal shaft, a boom cylinder for raising and lowering the boom, and an arm cylinder for pivoting the arm, the at least one device to be maintained installed to the upper slewing body so as to allow a maintenance space for a maintenance operation of the at least one device to be maintained to be secured thereover, and a winch which is driven to wind an operation rope. The method includes: attaching the winch to the upper slewing body so as to enable the winch to pivot about a winch support shaft between a use position for use of the winch, at which position the winch closes at least a part of the maintenance space, and a maintenance position at which position the winch opens the maintenance space upward to enable the maintenance operation to be performed; connecting the winch to a specific attachment element selected from the attachment elements through a drive-force transmission member; driving the specific attachment element or the winch and transmitting a drive force thereof to the winch through the drive-force transmission member to cause the winch pivot from the use position to the maintenance position; and performing the maintenance operation of the device to be maintained while the winch is located at the maintenance position.

This method enables the winch to be caused to pivot by utilization of a pivoting force of the boom or the arm which is an attachment element or utilization of a drive force of the winch per se. This eliminates the necessity of using another machine for lifting such as a crane in order to pivot the winch to thereby allow the maintenance operation to be further simplified.

As the drive-force transmission member, for example, preferably used is a pivoting-force transmission member for transmitting a pivoting force of the specific attachment element to the winch to thereby cause the winch to pivot from the use position to the maintenance position.

For performing the above method, it is preferable that: the working machine according to the present invention further comprises a pivoting-force transmission member provided between the winch and the attachment element so as to transmit a pivoting force of the attachment element to the winch to cause the winch to pivot from the use position to the maintenance position; and the winch and the attachment element are provided with respective fixation portions to which opposite end portions of the pivoting-force transmission member are fixed respectively.

In this case, the pivoting-force transmission member preferably includes a rod having a rigidity enough to transmit the pivoting force of the attachment elements to the winch as a pivoting force between the use position and the maintenance position with respect to either of opposite directions. The rod, having the rigidity enough to apply the pivoting force of the attachment elements to the winch as a pivoting force between the use position and the maintenance position with respect to either of opposite directions, enables the pivoting operation of the winch to be performed safely and swiftly in comparison with the case where, for example, the pivoting force transmission member is a traction rope which requires the pivot of the winch for returning to the use position to be performed by its own weight of the winch.

Besides, in a method according to the present invention, as the drive-force transmission member may be used an operation rope wound and rewound by drive of the winch. Specifically, the pivot of the winch between the use position and the maintenance position may be performed by driving the winch in a state where a tip of the operation rope is fixed to the specific attachment element.

This method also eliminates the necessity for pivoting operation of the attachment element to cause the winch to pivot from the use position to the maintenance position, thus allowing the pivot of the winch to be performed more simply.

In this case, in the working machine, the front attachment is preferably provided with a rope fixation portion to which the tip of the operation rope drawn from the winch is fixed so as to enable an operation of the winch for winding and rewinding the operation rope to cause the winch to pivot between the use position and the maintenance position.

This application is based on Japanese Patent application No. 2013-110749 filed in Japan Patent Office on May 27, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A working machine comprising:

a base machine;

at least one device to be maintained which is installed to the base machine and has a top surface; and a winch including a winch drum which is driven to wind an operation rope and a winch frame on which the winch drum is disposed, a winch support shaft which supports the winch in such a way as to allow the winch to pivot about the winch support shaft, with respect to the base machine, between a use position at which the winch is used while being disposed over the top surface and closing at least a part of a maintenance space for a maintenance operation, which maintenance space is defined over the top surface, and a maintenance position at which the winch is apart from the top surface and opens the maintenance space upward to thereby enable the maintenance operation to be performed; and a lock member removably attachable to the winch and the base machine for keeping the winch at the use position by fixing a portion of the winch frame of the winch located at the use position to the base machine, the portion being fixed by the lock member being spaced rearward of the winch support shaft and under the winch drum.

2. The working machine according to claim 1, further comprising a front attachment including a plurality of attachment elements and mounted to the base machine, wherein the base machine includes a lower traveler and an upper slewing body slewably mounted thereon, and the front attachment includes, as the plurality of attachment elements, a boom attached to the upper slewing body pivotably to be raised and lowered about a boom foot pin, an arm attached to a front end of the boom pivotably about a horizontal shaft, a boom cylinder for making the boom pivot to be raised and lowered, and an arm cylinder for making the arm pivot; and the device to be maintained and the winch are provided to the upper slewing body.

3. The working machine according to claim 2, further comprising an engine room installed to a rear portion of the upper slewing body on a rear side of a portion of the upper slewing body to which portion a boom foot as a base end portion of the boom is attached, the engine room having an opening portion opened upward, and an engine hood for opening and closing the opening portion of the engine room, wherein: the at least one device to be maintained includes a slewing motor provided between the engine room and the boom foot to slew the upper slewing body, a control valve provided between the engine room and the boom foot to control respective operations of a plurality of hydraulic actuators including the boom cylinder and the arm cylinder, and a plurality of engine related devices including an engine accommodated in the engine room and a device related to the engine; and the maintenance position is set to a position at which the winch opens a space over the slewing motor, the control valve, and the engine hood so as to allow the maintenance operations of the slewing motor and the control valve to be performed and so as to allow the engine hood to be opened.

4. The working machine according to claim 2, wherein:

the winch support shaft is a horizontal shaft in parallel with the boom foot pin; and a front end portion of the winch is attached to the upper slewing body through the winch support shaft so as to make the winch pivotable in a front and rear direction about the front end portion of the winch as a fulcrum.

5. The working machine according to claim 4, wherein the winch support shaft is disposed above a boom foot, which is a base end portion of the boom, and on a rear side of the boom foot.

6. The working machine according to claim 4, wherein the winch further includes another winch drum which is disposed adjacent to the winch drum in a front and rear direction and driven to wind an operation rope; and the use position is set to a position at which the winch has a front downward inclined attitude to vertically offset respective positions of respective rotation centers of the winch drums from each other.

7. The working machine according to claim 4, further comprising a pivoting-force transmission member provided between the winch and a specific attachment element selected from the attachment elements so as to transmit a pivoting force of the specific attachment element to the winch to cause the winch to pivot from the use position to the maintenance position, wherein the winch and the specific attachment element are provided with respective fixation portions to which opposite end portions of the pivoting-force transmission member are fixed respectively.

8. The working machine according to claim 7, wherein the pivoting force transmission member includes a rod having a rigidity enough to transmit the pivoting force of the specific attachment element to the winch as a pivoting force between the use position and the maintenance position with respect to either of opposite directions.

9. The working machine according to claim 4, wherein the front attachment is provided with a rope fixation portion to which a tip of the operation rope drawn from the winch is fixed so as to enable an operation of the winch for winding and rewinding the operation rope to cause the winch to pivot between the use position and the maintenance position.

10. The working machine according to claim 1, wherein the base machine includes a bottom plate supporting the at least one device to be maintained; and a frame extending upward to a position higher than the at least one device to be maintained, wherein the winch support shaft is attached to the frame at a position higher than the at least one device to be maintained, and the lock member fixes the winch frame to the frame at a position higher than the at least one device to be maintained and rearward of the winch support shaft.

11. A method of performing a maintenance operation of at least one device to be maintained of a working machine including a lower traveler, an upper slewing body slewably mounted thereon, a front attachment including a plurality of attachment elements and mounted to the upper slewing body, the attachment elements including a boom attached to the upper slewing body movably about a boom foot pin so as to be raised and lowered, an arm attached to a front end of the boom pivotably about a horizontal shaft, a boom cylinder for raising and lowering the boom, and an arm cylinder for pivoting the arm, the at least one device to be maintained installed to the upper slewing body and having a top surface, and a winch which is driven to wind an operation rope, the method comprising:

attaching the winch to the upper slewing body so as to enable the winch to pivot, about a winch support shaft, between a use position at which the winch is used while being disposed over the top surface and closing at least a part of a maintenance space for a maintenance operation, which maintenance space is defined over the top surface, and a maintenance position at which the winch is apart from the top surface and opens the maintenance space upward to enable the maintenance operation to be performed;

connecting the winch to a specific attachment element selected from the attachment elements through a drive-force transmission member;

driving the specific attachment element or the winch and transmitting a drive force thereof to the winch through the drive-force transmission member to cause the winch to pivot from the use position to the maintenance position; and performing the maintenance operation of the device to be maintained while the winch is located at the maintenance position.

12. The method of performing a maintenance operation of a working machine according to claim 11, wherein a pivoting force-transmission member for transmitting a pivoting force of the specific attachment element to the winch to cause the winch to pivot from the use position to the maintenance position is used as the drive-force transmission member.

13. The method of performing a maintenance operation of a working machine according to claim 11, wherein:

the operation rope wound and rewound by drive of the winch is used as the drive-force transmission member; and the pivot of the winch between the use position and the maintenance position is performed by driving the winch in a state where a tip of the operation rope is fixed to the specific attachment element.

* * * * *